US008534512B2

(12) United States Patent
Choi

(10) Patent No.: US 8,534,512 B2
(45) Date of Patent: Sep. 17, 2013

(54) SHIRT PRESS

(76) Inventor: Yoon Sup Choi, Uiwang-si (KR)

( * ) Notice: Subject to any disclaimer, the term of this patent is extended or adjusted under 35 U.S.C. 154(b) by 474 days.

(21) Appl. No.: 12/717,963

(22) Filed: Mar. 5, 2010

(65) Prior Publication Data

US 2010/0224658 A1 Sep. 9, 2010

(30) Foreign Application Priority Data

Mar. 6, 2009 (KR) ..... 10-2009-0019424
Jul. 31, 2009 (KR) ..... 10-2009-0070691

(51) Int. Cl.
*D06C 15/00* (2006.01)

(52) U.S. Cl.
USPC ..... 223/52.1

(58) Field of Classification Search
USPC ..... 223/52, 52.1, 52.5, 57, 61, 66, 70, 223/72
See application file for complete search history.

(56) References Cited

U.S. PATENT DOCUMENTS 3,484,820 A * 12/1969 McMillan ..... 223/57
3,749,292 A * 7/1973 Engelbart ..... 223/57
5,636,773 A * 6/1997 Harrod et al. ..... 223/57
5,722,572 A * 3/1998 Pessina ..... 223/70
6,868,996 B1 * 3/2005 Uchikoshi ..... 223/61
7,314,151 B2 * 1/2008 Myoji ..... 223/70
7,392,919 B2 * 7/2008 Uchikoshi ..... 223/72
7,438,205 B2 * 10/2008 Uchikoshi ..... 223/73
7,530,481 B2 * 5/2009 Kim ..... 223/70
7,594,597 B2 * 9/2009 Uchikoshi ..... 223/70
2008/0035684 A1 * 2/2008 Uchikoshi ..... 223/73
2008/0185406 A1 * 8/2008 Uchikoshi ..... 223/73
2009/0008418 A1 * 1/2009 Uchikoshi ..... 223/57
2010/0224658 A1 * 9/2010 Choi ..... 223/52.1

* cited by examiner

*Primary Examiner* — Shelley Self
*Assistant Examiner* — Andrew Sutton
(74) *Attorney, Agent, or Firm* — Ladas & Parry LLP

(57) ABSTRACT

A shirt frame including a fixed frame installed on ground, a model installed on the fixed frame, for supporting a shirt, a front iron installed on the fixed frame and movable towards the model so as to iron a front part of the shirt supported on the model, a rear iron installed on the fixed frame and moveable towards the model so as to iron a rear part of the shirt supported on the model, a sleeve supporter installed on the fixed frame, for stretching a sleeve of the shirt supported on the model, and a lateral stretcher installed on the fixed frame and including at least one rods that are folded and unfolded in both directions with respect to the model so as to stretch lateral surfaces of the shirt supported on the model. The quality of an ironing operation is maximized, and an operating speed of a user is increased. Upper and lower surfaces of a sleeve of shirt are uniformly ironed, sleeves are easily supported, and thus creases of the sleeves are prevented.

4 Claims, 22 Drawing Sheets

SHIRT PRESS

CROSS-REFERENCE TO RELATED PATENT APPLICATION

This application claims the benefit of Korean Patent Application No. 10-2009-0019424, filed on Mar. 6, 2009 and Korean Patent Application No. 10-2009-0070691, filed on Jul. 31, 2009, in the Korean Intellectual Property Office, the disclosure of which is incorporated herein in its entirety by reference.

BACKGROUND OF THE INVENTION

1. Field of the Invention

The present invention relates to a shirt press, and more particularly, to a shirt press for easily ironing various shits such as dress shirts, maintaining optimum quality, that is, an optimum ironing state of each part of the shirts, and simultaneously, easily and quickly ironing collar and sleeves of the shirts.

2. Description of the Related Art

Generally, in laundries and large-scaled accommodations, a large-scaled washing machine and an ironing machine are widely used to clean a large amount of laundry.

There are many kinds of ironing machines. From among these ironing machines, a shirt press performs ironing by spraying hot air or steam onto a shirt such as a dress shirt while ironing the shirt on an ironing board.

A conventional shirt press includes a fixed frame installed on ground; a model installed on the fixed frame, for supporting a shirt; a front iron installed on the fixed frame and movable towards the model so as to iron a front part of the shirt supported on the model; and a rear iron installed on the fixed frame and moveable towards the model so as to iron a rear part of the shirt supported on the model, thereby reducing a user's ironing period of time.

However, it is difficult for the conventional shirt press to iron both lateral parts, sleeves, and adjacent parts thereto of the shirt which wrinkle easily, and thus the ironing result is not good. In this case, it is required to perform separate ironing operations on these parts manually.

Normally, since collar and sleeves of a shirt cannot be ironed by the conventional shirt press, a user needs to iron the collar and sleeves by using a separate iron after or prior to ironing the shirt by using the shirt press, and thus doubled or trebled manual operations are required.

SUMMARY OF THE INVENTION

The present invention provides a shirt press for cleanly ironing lateral surfaces, sleeves and adjacent parts thereof so as to increase the quality of ironing and increase a user's operating speed.

The present invention also provides a shirt press for uniformly ironing upper and lower surfaces of a sleeve by adjusting a direction angle of the sleeve of the shirt, and for preventing creases of the sleeve by easily supporting the sleeve by using a sleeve supporting member when the sleeve is supported.

The present invention also provides a shirt collar and sleeve ironing device that may easily and quickly iron a collar and a sleeve of a shirt, may maximize the quality of an ironing operation by a great pressing force by using a hydraulic cylinder with a small capacity by primarily pressing the sleeve of the shirt by using a sleeve iron and secondarily pressing the sleeve and collar of the shirt by using a collar iron in the same direction as the sleeve iron, and may obtain space saving and user's convenience by minimizing the size of the shirt collar and sleeve ironing device and installing a deck truck or a shirt press together with the shirt collar and sleeve ironing device.

According to an aspect of the present invention, there is provided a shirt press includes a fixed frame installed on ground, a model installed on the fixed frame, for supporting a shirt, a front iron installed on the fixed frame and movable towards the model so as to iron a front part of the shirt supported on the model, a rear iron installed on the fixed frame and moveable towards the model so as to iron a rear part of the shirt supported on the model, a sleeve supporter installed on the fixed frame, for stretching a sleeve of the shirt supported on the model, and a lateral stretcher installed on the fixed frame and including at least one rods that are folded and unfolded in both directions with respect to the model so as to stretch lateral surfaces of the shirt supported on the model.

The lateral stretcher may include a base installed on the fixed frame; at least one link hinged to the base; a first rod connected to the at least one link so as to rotate in both lateral directions of the shirt; a second rod hinged to the first rod; an elastic spring installed between the first rod and the second rod, for acting a restoring force on the second rod in both lateral direction of the shirt supported on the model with respect to the first rod; and a lateral tension actuator installed on the base and connected to an end of one of the at least one link, for rotating and reversely rotating the at least one link.

The lateral stretcher may further include a stretcher elevating actuator installed on the fixed frame and connected to the base, for ascending and descending the base.

The shirt press may further include a shoulder iron installed above the fixed frame and moveable so as to iron a shoulder part of the shirt supported on the model; and a fan for supplying high-temperature air to the model.

The sleeve supporter may include a sleeve frame hinged to the fixed frame and rotatable by a sleeve stretching actuator; a sleeve supporting member installed on the sleeve frame, for supporting the sleeve of the shirt; a sleeve iron moveable towards the sleeve so as to iron the sleeve of the shirt supported on the sleeve supporting member; and a sleeve axial rotation actuator that axially rotates the sleeve supporting member in such a way the sleeve is easily attached to and supported on the sleeve supporting member when the sleeve of the shirt is supported.

The sleeve supporting member may include a sleeve direction angle adjusting actuator hinged to the sleeve frame, and connected between the sleeve frame and the sleeve supporting member so as to adjust a sleeve direction angle of the sleeve supporting member by tension of the sleeve of the sleeve of the shirt.

The sleeve supporter may include a sleeve crease iron that is moveable towards creases of adjacent parts of the sleeve of the shirt so as to iron the creases of the adjacent parts of the sleeve of the shirt.

The shirt press may further include a shirt collar and sleeve ironing device installed on the fixed frame or front and rear irons, for ironing a collar and sleeves of a shirt.

The shirt collar and sleeve ironing device further a frame; a sleeve supporting member installed in the frame, for supporting sleeves of a shirt; a sleeve iron installed in the frame, for ironing the sleeves of the shirt supported on the sleeve supporting member; a first actuator for moving the sleeve iron towards the sleeve supporting member; a collar supporting member installed in the frame, for supporting a collar of the shirt; a collar iron installed in the frame, for ironing the collar of the shirt supported on the collar supporting member; and a second actuator for moving the collar iron towards the collar supporting member.

The shirt collar and sleeve ironing device may further include a moving member installed on a fixed frame or front and rear irons, and moveable towards the sleeve supporting member, wherein a collar supporting member on which the collar of the shirt is supported is installed on one surface of the moving member, and wherein a sleeve iron for ironing the sleeve of the shirt supported on the sleeve supporting member is installed on the other surface of the moving member.

The first actuator may include a hydraulic cylinder installed below the frame so as to move the sleeve iron towards the sleeve supporting member, for primarily descending the moving member towards the sleeve supporting member, and the second actuator may include a hydraulic cylinder installed above the frame so as to move the collar iron towards the collar supporting member 150 of the moving member, for secondarily descending the collar iron towards the moving member.

The frame may be detachably installed on the front iron. The frame may be detachably installed on a deck truck including wheels formed on a bottom of the deck truck when the frame is detached from the front iron.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
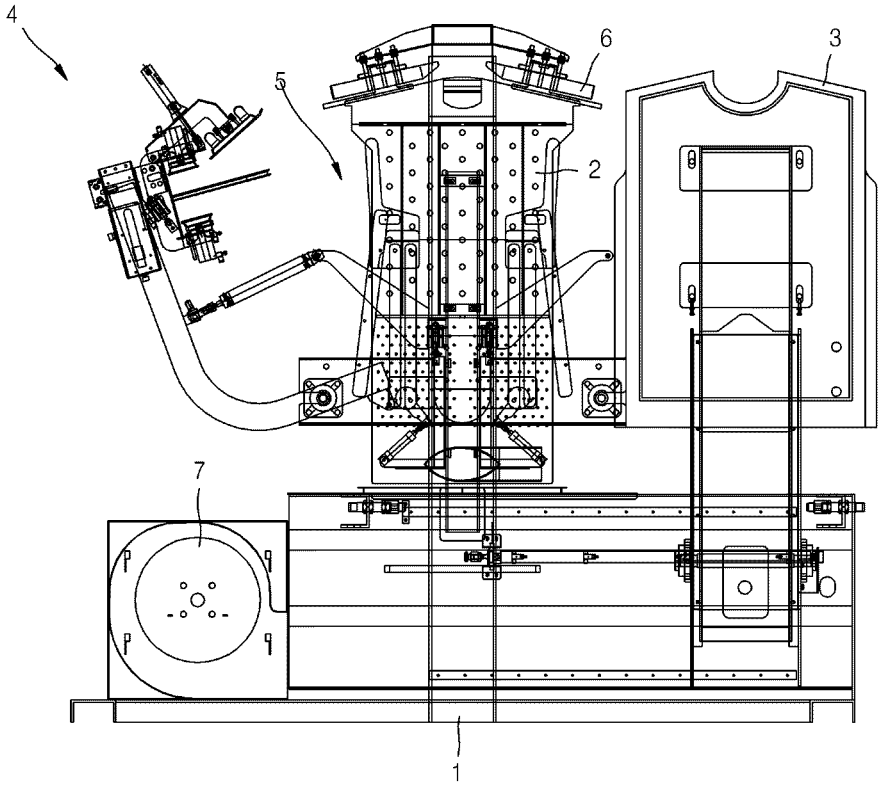
FIG. 1 is a front view of a shirt press according to an embodiment of the present invention.
Figure 2:
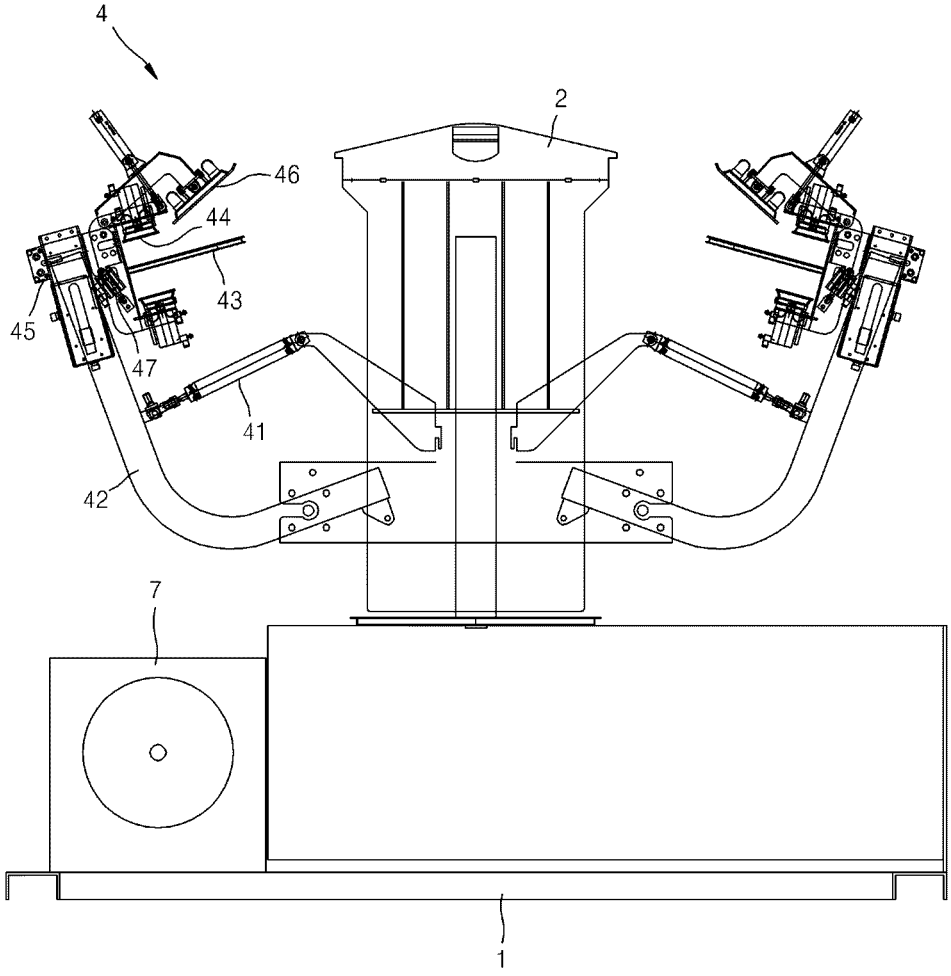
FIG. 2 is a front view of a sleeve supporter of FIG. 1, according to an embodiment of the present invention.
Figure 7:
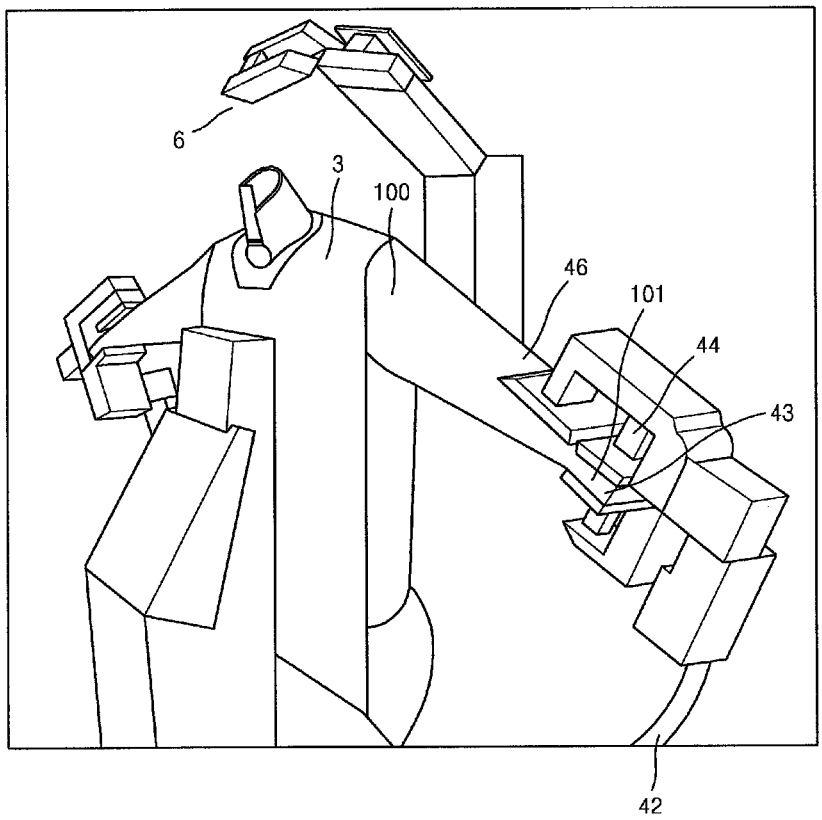
FIG. 7 is a perspective image of a case where a shirt is supported on the shirt press of FIG. 1.
Figure 8:
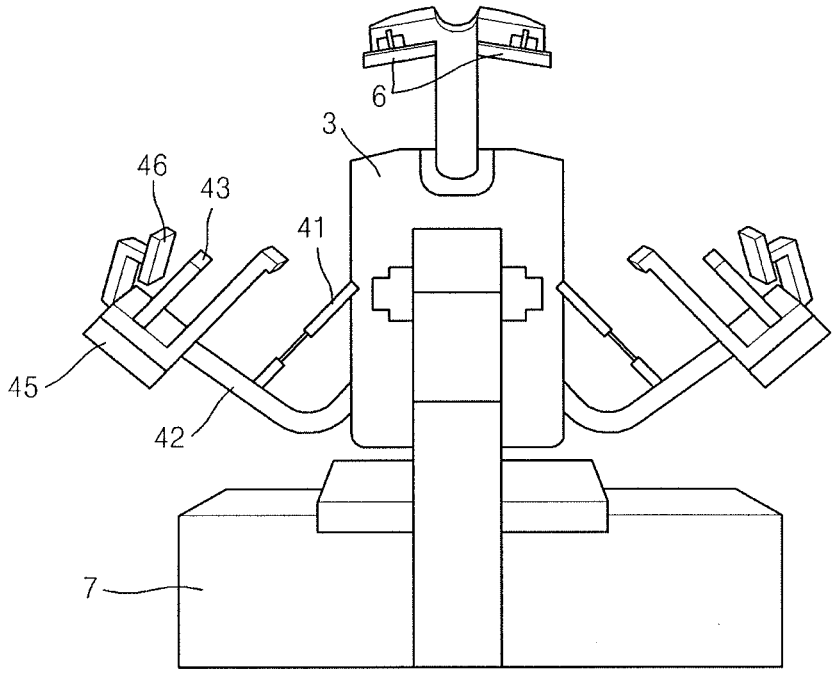
FIG. 8 is a front image of the shirt press of FIG. 1.

FIG. 1 is a front view of a shirt press according to an embodiment of the present invention. FIG. 2 is a front view of a sleeve supporter 4 of FIG. 1, according to an embodiment of the present invention. FIG. 7 is a perspective image of a case where a shirt is supported on the shirt press of FIG. 1. FIG. 8 is a front image of the shirt press of FIG. 1.

With reference to FIGS. 1, 2, 7 and 8, comparative embodiments will be described.

Referring to FIGS. 1, 2, 7 and 8, the shirt press according to the present embodiment includes a fixed frame 1, a model 2, a front iron 3, a rear iron 8, the sleeve supporter 4, a lateral stretcher 5, a shoulder iron 6 and a fan 7.

The fixed frame 1 is installed on a bottom of a laundry, a hotel or a large-scaled accommodation, or ground, and supports the model 2, the front iron 3, the rear iron 8, the sleeve supporter 4, the lateral stretcher 5, the shoulder iron 6 and the fan 7.

The model 2 may have a shape corresponding to a human's upper body so as to support a shirt 100 such as a dress shirt.

The front iron 3 is on standby on the right of the model 2, and is movable to slide towards the model 2 in order to iron a front part of the shirt 100 supported on the model 2.

The rear iron 8 is movable to slide towards the model 2 in order to iron a rear part of the shirt 100 supported on the model 2.

Figure 5:
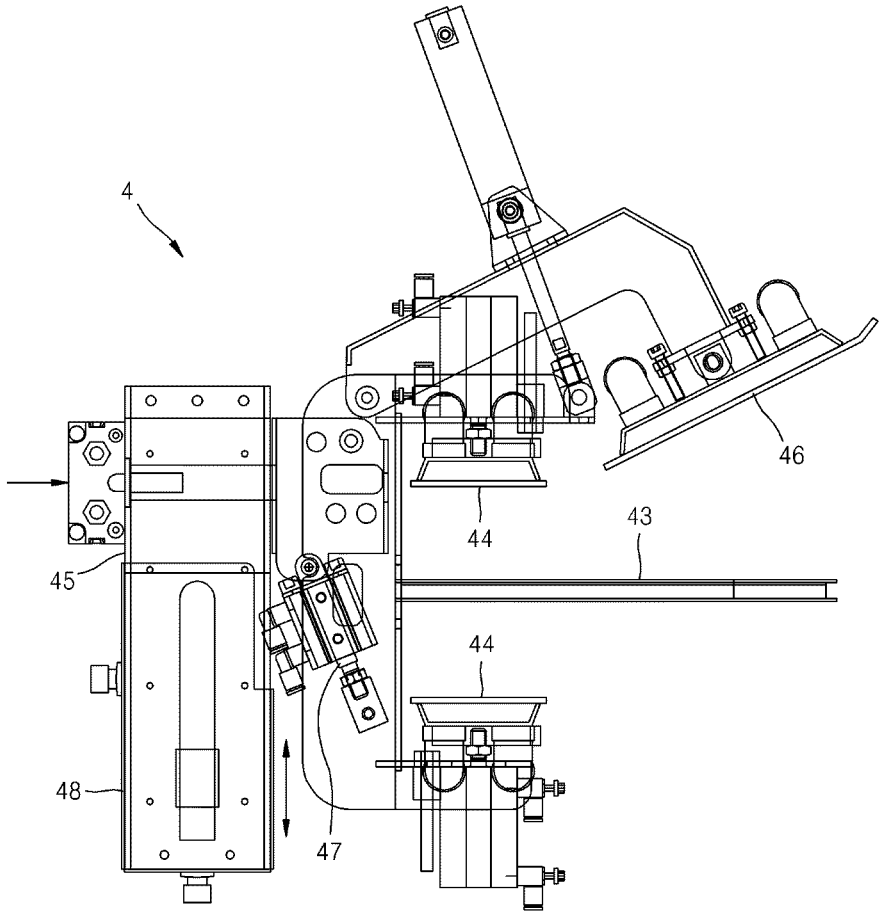
FIG. 5 is a magnified diagram of a sleeve supporting member of a sleeve supporter when a sleeve supporting member is on standby, according to an embodiment of the present invention.
Figure 6:
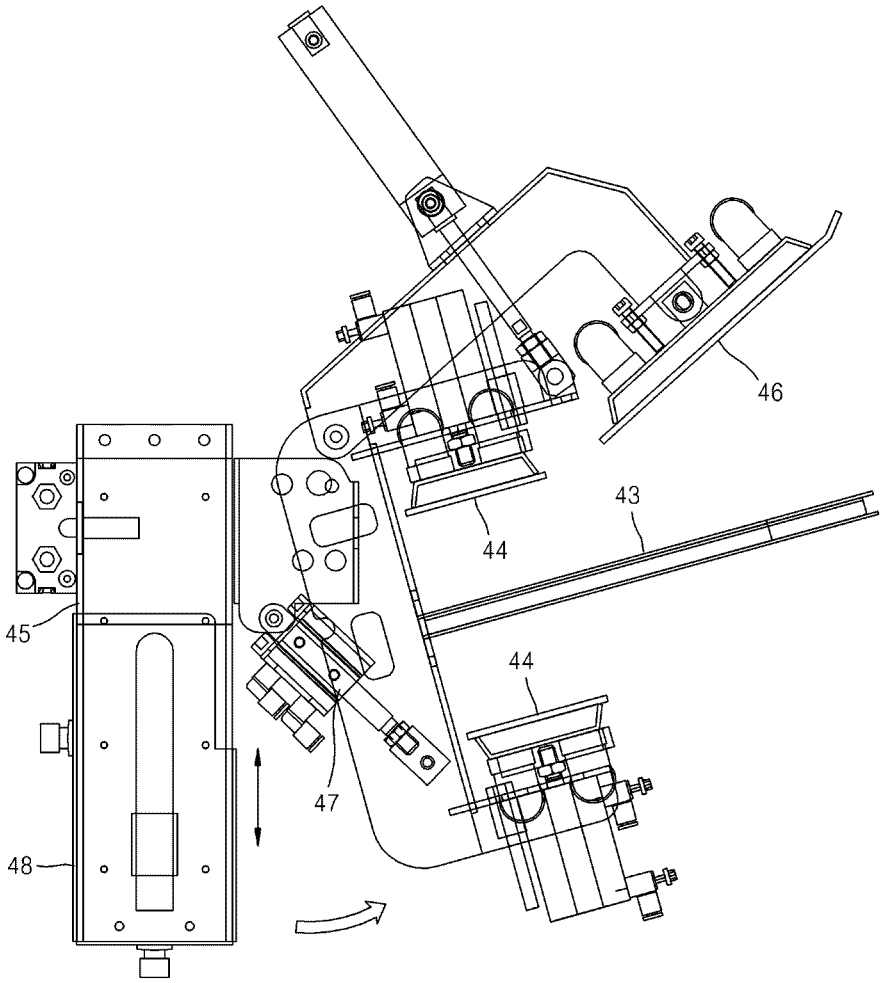
FIG. 6 is a magnified diagram of the sleeve supporting member of the sleeve supporter of FIG. 5 when the sleeve supporting member is adjusted at a sleeve direction angle, according to an embodiment of the present invention.
Figure 9:
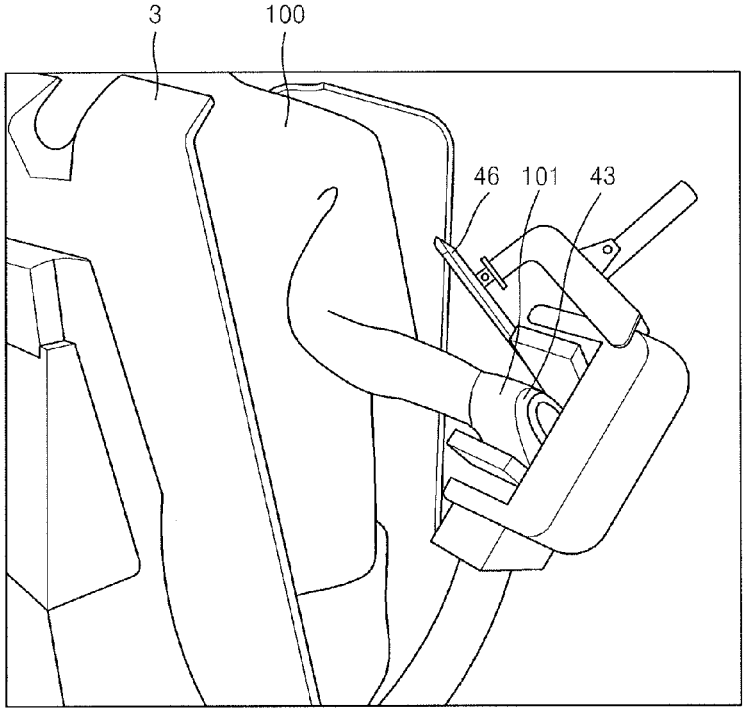
FIG. 9 is a perspective image of the sleeve supporting member of the sleeve supporter of FIG. 1 when a sleeve is supported on the sleeve supporting member.
Figure 10:
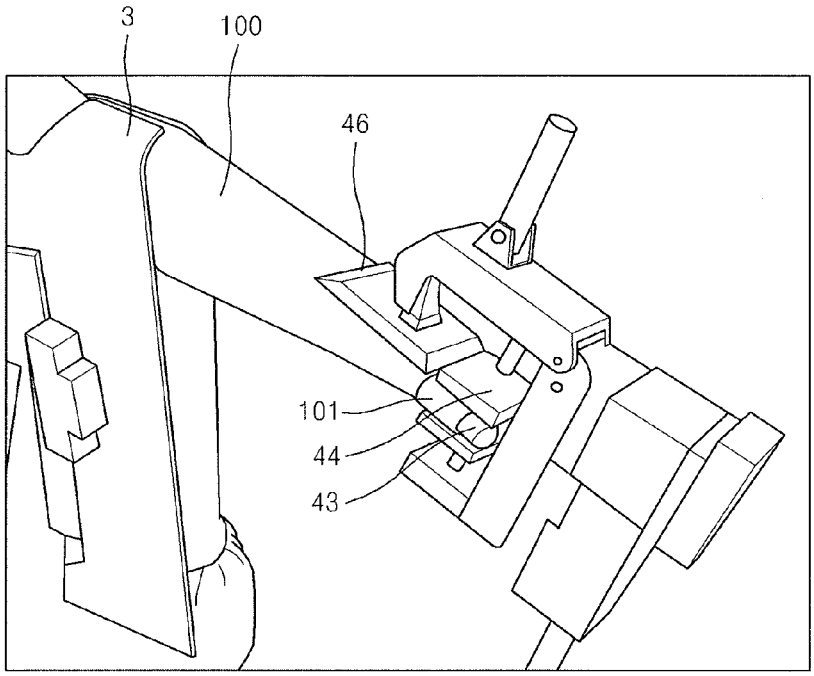
FIG. 10 is a perspective image of the sleeve supporting member of the sleeve supporter of FIG. 1 while the sleeve 101 is ironed.
Figure 11:
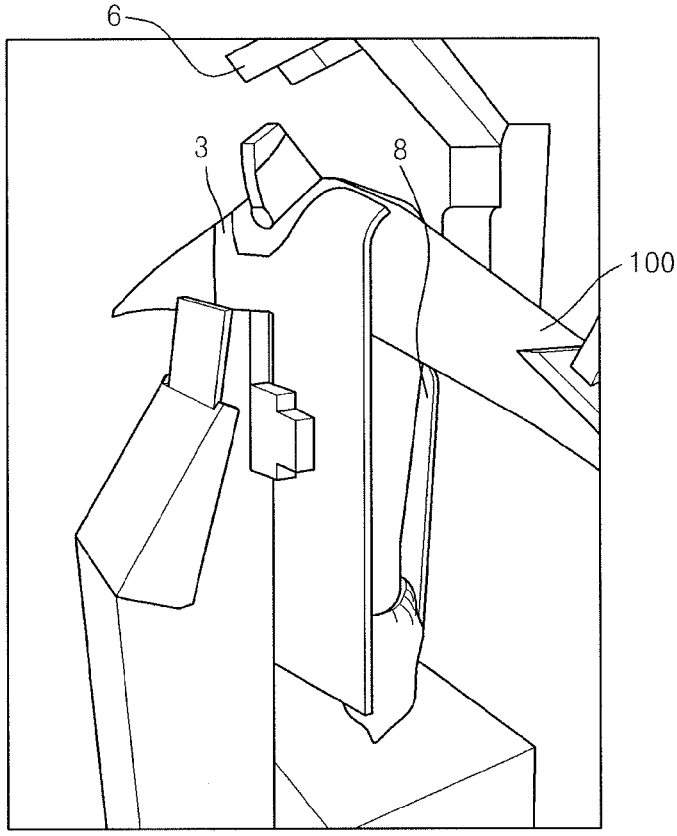
FIG. 11 is a lateral image of the shirt press of FIG. 1.

FIG. 5 is a magnified diagram of a sleeve supporting member 43 of the sleeve supporter 4 when the sleeve supporting member 43 is on standby, according to an embodiment of the present invention. FIG. 6 is a magnified diagram of the sleeve supporting member 43 of the sleeve supporter 4 of FIG. 5 when the sleeve supporting member 43 is adjusted at a sleeve direction angle, according to an embodiment of the present invention. FIG. 9 is a perspective image of the sleeve supporting member 43 of the sleeve supporter 4 of FIG. 1 when a sleeve 101 is supported on the sleeve supporting member 43. FIG. 10 is a perspective image of the sleeve supporting member 43 of the sleeve supporter 4 of FIG. 1 while the sleeve 101 is ironed.

As shown in FIGS. 2, 5, 6, 9 and 10, the sleeve supporter 4 stretches the sleeve 101 of the shirt 100 supported on the model 2, and includes a sleeve frame 42 hinged to the fixed frame 1 and rotatable by a sleeve stretching actuator 41, the sleeve supporting member 43 installed on the sleeve frame 42 and supporting the sleeve 101 of the shirt 100, a sleeve iron 44 that is moveable towards the sleeve 101 so as to iron the sleeve 101 of the shirt 100 supported on the sleeve supporting member 43, a sleeve axial rotation actuator 45 that axially rotates the sleeve supporting member 43 in such a way the sleeve 101 is easily attached to and supported on the sleeve supporting member 43 when the sleeve 101 of the shirt 100 is supported, and a sleeve crease iron 46 that is moveable towards creases of adjacent parts of the sleeve 101 of the shirt 100 supported on the sleeve supporting member 43.

A sleeve direction angle adjusting actuator 47 may be installed between the sleeve frame 42 and the sleeve supporting member 43 so as to adjust a sleeve direction angle of the sleeve supporting member 43 by tension of the sleeve 101 of the sleeve 101 of the shirt 100.

As shown in FIGS. 5 and 6, the sleeve supporter 4 may further include a sleeve supporter elevating actuator 48 formed on the sleeve frame 42, for ascending and descending the sleeve supporting member 43 so as to adjust a height of the sleeve 101 of the shirt 100 supported on the sleeve supporting member 43.

An operation of the sleeve supporter 4 will be described. As shown in FIG. 5, when the sleeve supporting member 43 is in on standby, that is, when the shirt 100 is not supported on the sleeve supporting member 43, since the tension of the shirt 100 does not act on the sleeve supporting member 43, the sleeve direction angle is not adjusted. However, as shown in FIG. 6, when the shirt 100 is supported on the sleeve supporting member 43, the sleeve direction angle of the sleeve supporting member 43 hinged to the sleeve frame 42 is automatically adjusted by the tension of the sleeve 101 of the shirt 100, or the sleeve direction angle may be adjusted by the sleeve supporter elevating actuator 48.

Figure 3:
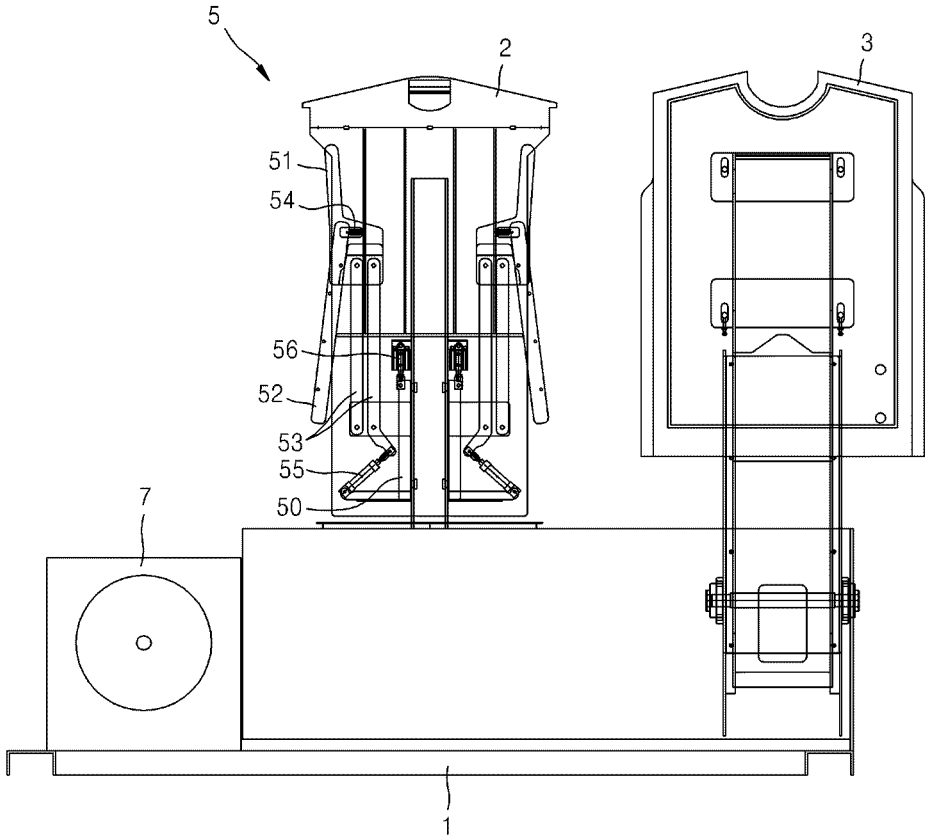
FIG. 3 is a front view of the shirt press when first and second rods of a lateral stretcher of FIG. 1 are folded, according to an embodiment of the present invention.
Figure 4:
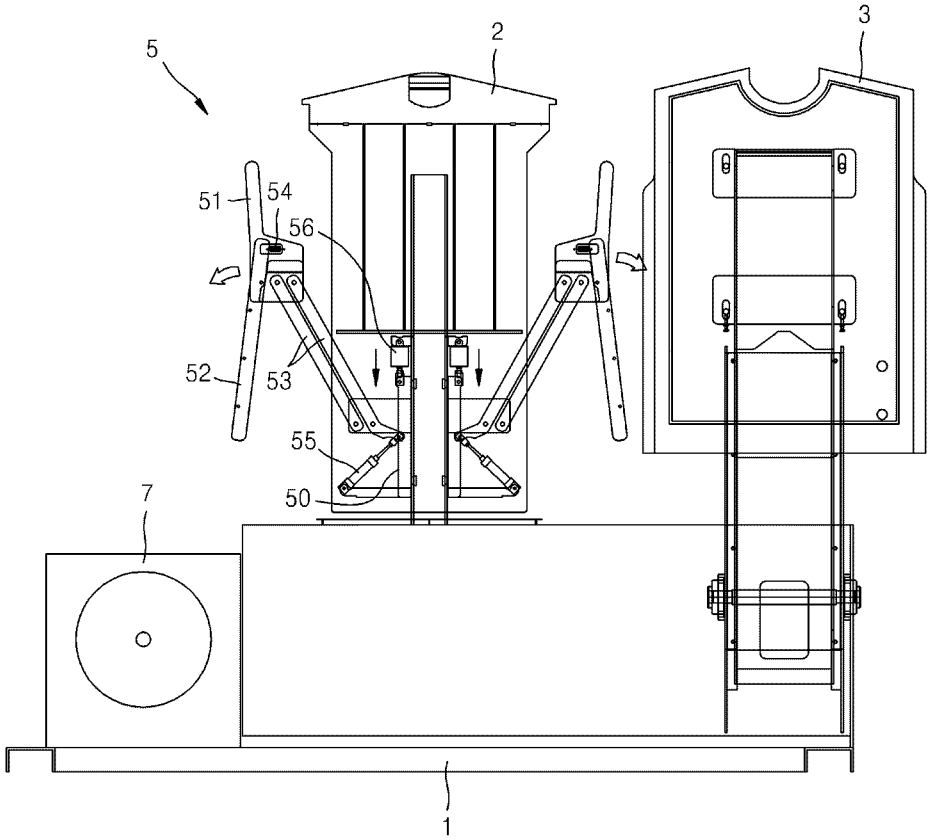
FIG. 4 is a front view of the first and second rods of the lateral stretcher of FIG. are unfolded, according to an embodiment of the present invention.
Figure 12:
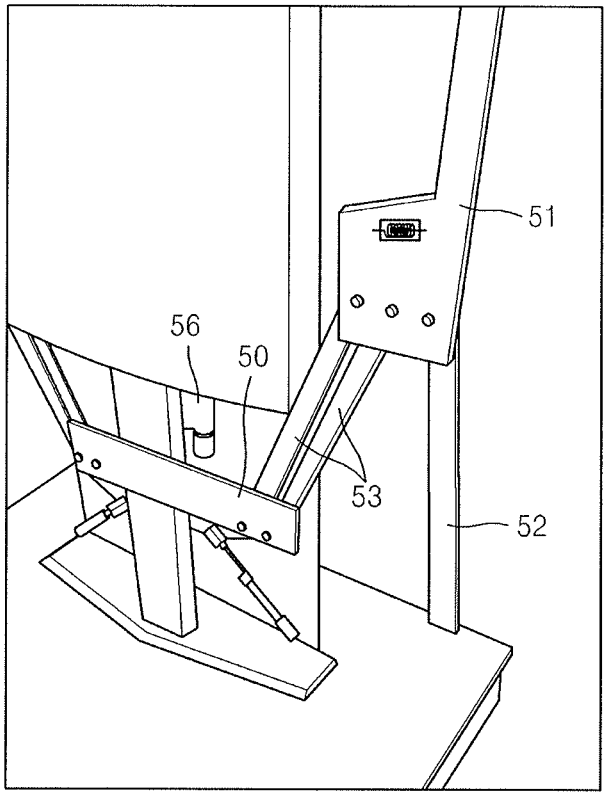
FIG. 12 is a perspective image of the lateral stretcher of FIG. 1.
Figure 13:
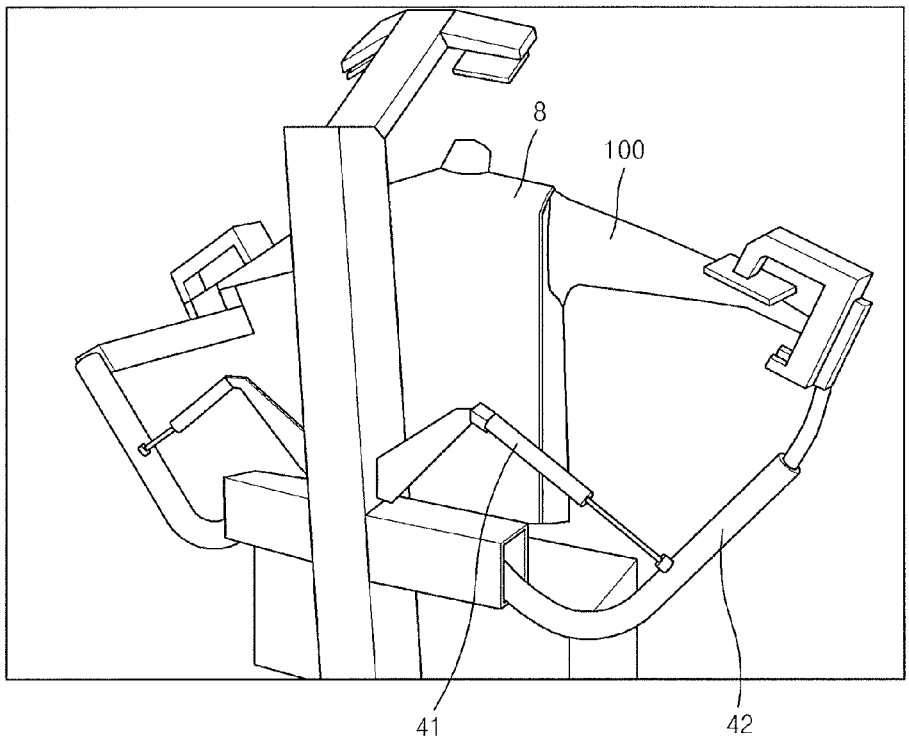
FIG. 13 is a perspective image of back of the shirt press of FIG. 1, which is back of the image of FIG. 8.

FIG. 3 is a front view of the shirt press when first and second rods 51 and 52 of the lateral stretcher 5 of FIG. 1 are folded, according to an embodiment of the present invention. FIG. 4 is a front view of the first and second rods 51 and 52 of the lateral stretcher 5 of FIG. 1 are unfolded, according to an embodiment of the present invention. FIG. 12 is a perspective image of the lateral stretcher 5 of FIG. 1. FIG. 13 is a perspective image of back of the shirt press of FIG. 1, which is back of the image of FIG. 8.

As shown in FIGS. 3, 4, 12 and 13, the lateral stretcher 5 includes the first and second rods 51 and 52 that are folded and unfolded in both directions with respect to the model 2 so as to stretch lateral surfaces of the shirt 100 supported on the model 2.

The lateral stretcher 5 includes a base 50 installed on the fixed frame 1, two links installed in parallel to each other and hinged to the base 50, the first rod 51 connected to the links 53 so as to rotate in both lateral directions of the shirt 100, the second rod 52 hinged to the first rod 51, an elastic spring 54 installed between the first rod 51 and the second rod 52, for acting a restoring force on the second rod 52 in both lateral direction of the shirt 100 supported on the model 2 with respect to the first rod 51, a lateral tension actuator 55 installed on the base 50 and connected to an end of one of the links 53, for rotating and reversely rotating the links 53, and a stretcher elevating actuator 56 installed on the fixed frame 1, and a stretcher elevating actuator 56 connected to the base 50, for ascending and descending the base 50.

An operation of the lateral stretcher 5 will be described. As shown in FIG. 3, when the sleeve supporting member 43 is in on standby, that is, when the shirt 100 is not supported on the sleeve supporting member 43, the lateral tension actuator 55 reversely rotates the links 53 to fold the first rod 51 and the second rod 52. As shown in FIG. 4, when the shirt 100 is supported on the model 2, the lateral tension actuator 55 rotates the links 53 so that the first rod 51 and the second rod 52 may be unfolded so that both surfaces of the shirt 100 having many creases may be stretched and ironed.

Then, as shown in FIGS. 12 and 13, when the first rod 51 and the second rod 52 that stretch the shirt 100 are descended by the stretcher elevating actuator 56, both lateral surfaces of the shirt 100 are stretched, and simultaneously are pulled downwards. Accordingly, the both surfaces of the shirt 100 are stretched in vertical directions, and thus the both surfaces of the shirt 100 may be uniformly and cleanly ironed.

The shoulder iron 6 is installed above the fixed frame 1, and is moveable so as to iron a shoulder part of the shirt 100 supported on the model 2. The fan 7 supplies high-temperature air to the model 2 so as to remove fine creases of the shirt 100 by inflating the shirt 100 by an air pressure during ironing.

Figure 14:
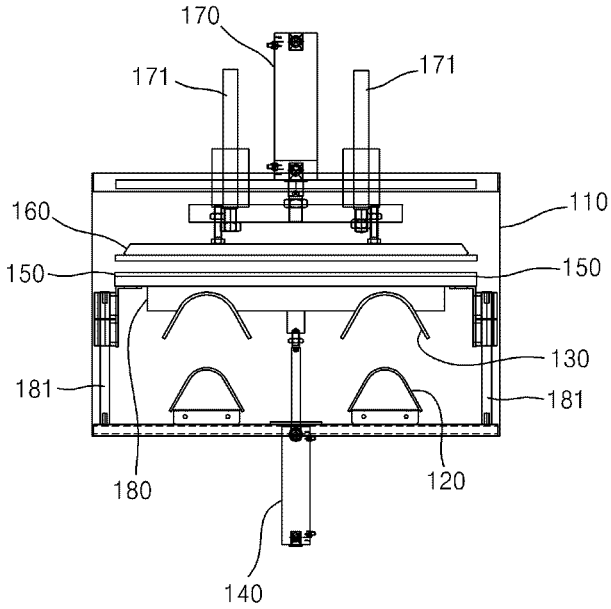
FIG. 14 is a front view of a shirt collar and sleeve ironing device when the shirt collar and sleeve ironing device is on standby on, according to an embodiment of the present invention.
Figure 15:
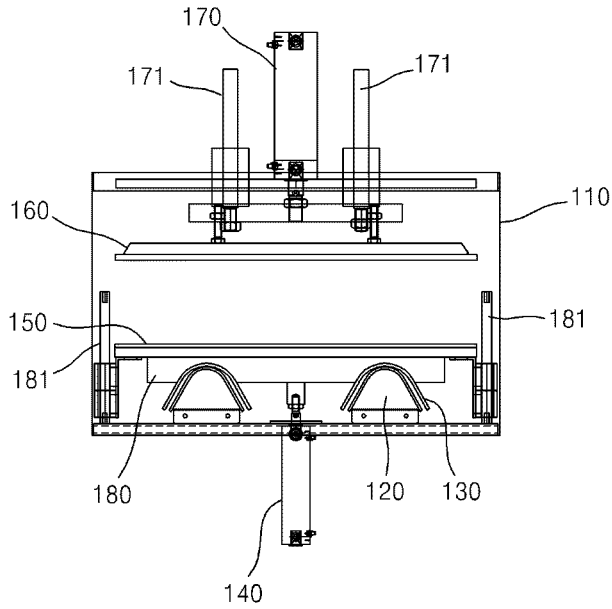
FIG. 15 is a front view of the shirt collar and sleeve ironing device of FIG. 14 while sleeves are ironed, according to an embodiment of the present invention.
Figure 16:
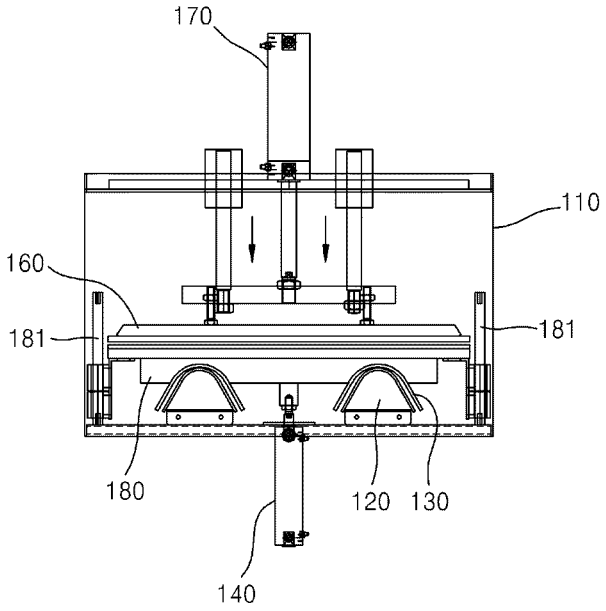
FIG. 16 is a front view of the shirt collar and sleeve ironing device of FIG. 14 when a collar is ironed, according to an embodiment of the present invention.

FIG. 14 is a front view of a shirt collar and sleeve ironing device when the shirt collar and sleeve ironing device is on standby on, according to an embodiment of the present invention. FIG. 15 is a front view of the shirt collar and sleeve ironing device of FIG. 14 while sleeves are ironed, according to an embodiment of the present invention. FIG. 16 is a front view of the shirt collar and sleeve ironing device of FIG. 14 when a collar is ironed, according to an embodiment of the present invention.

As shown in FIGS. 14 through 16, a shirt press according to another embodiment of the present invention may further include the shirt collar and sleeve ironing device installed on a fixed frame or front and rear irons, for ironing the collar and sleeves of a shirt.

The shirt collar and sleeve ironing device includes a frame 110, a sleeve supporting member 120, a sleeve iron 130, a first actuator 140, a collar supporting member 150, a collar iron 160, a second actuator 170 and a moving member 180.

The frame 110 is a structure for supporting the sleeve supporting member 120, the sleeve iron 130, the first actuator 140, the collar supporting member 150, the collar iron 160, the second actuator 170 and the moving member 180.

The sleeve supporting member 120 is installed in the frame 110. Two of the sleeve supporting member 120 are respectively formed on the right and left, and are each shaped like a reverse U shape so as to easily support the sleeve 101 of the shirt 100.

The sleeve iron 130 is installed on the moving member 180 of the frame 110, and has a shape corresponding to the sleeve supporting member 120 so as to press and iron the sleeve 101 supported on the sleeve supporting member 120.

Although not illustrated, a heating pipe or electric heater in which a high-temperature heat medium is circulated may be installed in the sleeve supporting member 120 or the sleeve iron 130, and may heat the sleeve 101 of the shirt 100, thereby cleanly ironing creases of the sleeve 101.

The collar supporting member 150 supports a collar 103 of the shirt 100. The collar iron 60 irons the collar 103 supported on the collar supporting member 150.

Although not illustrated, a heating pipe or electric heater in which a high-temperature heat medium is circulated may be installed in the collar supporting member 150 or the collar iron 60, and may heat the collar 103 of the shirt 100, thereby cleanly ironing creases of the collar 103.

The moving member 180 is installed in the frame 110 so as to move upwards and downwards, and is moveable along guides 181 towards the sleeve supporting member 120.

That is, the collar supporting member 150 on which the collar 103 of the shirt 100 is supported is installed on one surface of the moving member 180. The sleeve iron 130 for ironing the sleeve 101 of the shirt 100 supported on the sleeve supporting member 120 is installed on the other surface of the moving member 180.

The first actuator 140 moves the sleeve iron 130 towards the sleeve supporting member 120. A hydraulic cylinder for primarily descending the moving member 180 towards the sleeve supporting member 120 is installed below the frame 110 so as to move the sleeve iron 130 towards the sleeve supporting member 120.

The second actuator 170 moves the collar iron 160 towards the collar supporting member 150. A hydraulic cylinder for secondarily descending the collar iron 160 towards the moving member 180 along guides 171 is installed above the frame 110 so as to move the collar iron 160 towards the collar supporting member 150 of the moving member 180.

The first actuator 140 and the second actuator 170 may include various actuators such as linear motors, apart from the hydraulic cylinders.

The operation of the shirt collar and sleeve ironing device according to the present embodiment will be described. As shown in FIG. 14, the sleeve 101 is supported on the sleeve supporting member 120. Then, as shown in FIG. 15, the sleeve iron 130 is primarily attached to the sleeve supporting member 120 by descending the moving member 180 by using the first actuator 140.

Then, the collar 103 of the shirt 100 is supported on the collar supporting member 150 installed on the moving member 180 of FIG. 15. Then, as shown in FIG. 16, the collar iron 160 is secondarily attached to the collar supporting member 150 by descending the collar iron 160 by using the second actuator 170.

In this case, the sleeve 101 of the shirt 100 is primarily attached between the sleeve supporting member 120 and the sleeve iron 130 by the first actuator 140, and simultaneously is secondarily attached between the sleeve supporting member 120 and the sleeve iron 130 by the second actuator 170. Thus, the quality of an ironing operation may be maximized by a great pressing force by using a hydraulic cylinder with a small capacity, and the size of the shirt press may be minimized.

Since the size of the shirt press may be reduced, the shirt press may be detachably installed in various places.

Figure 17:
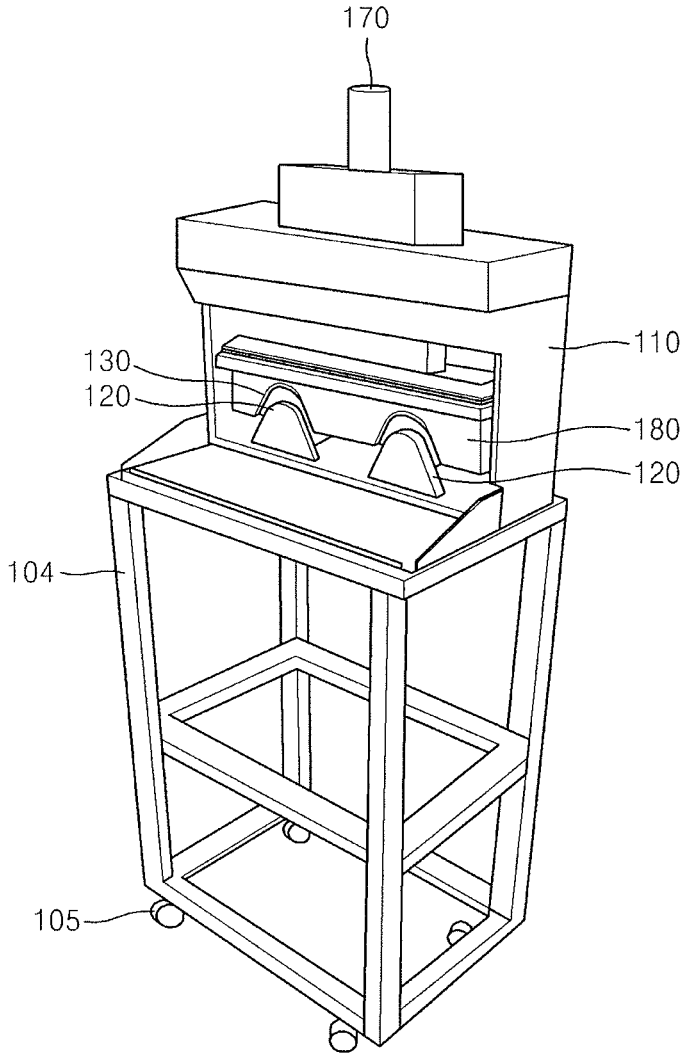
FIG. 17 is an image of a case where a shirt collar and sleeve ironing device is installed on a deck truck.
Figure 18:
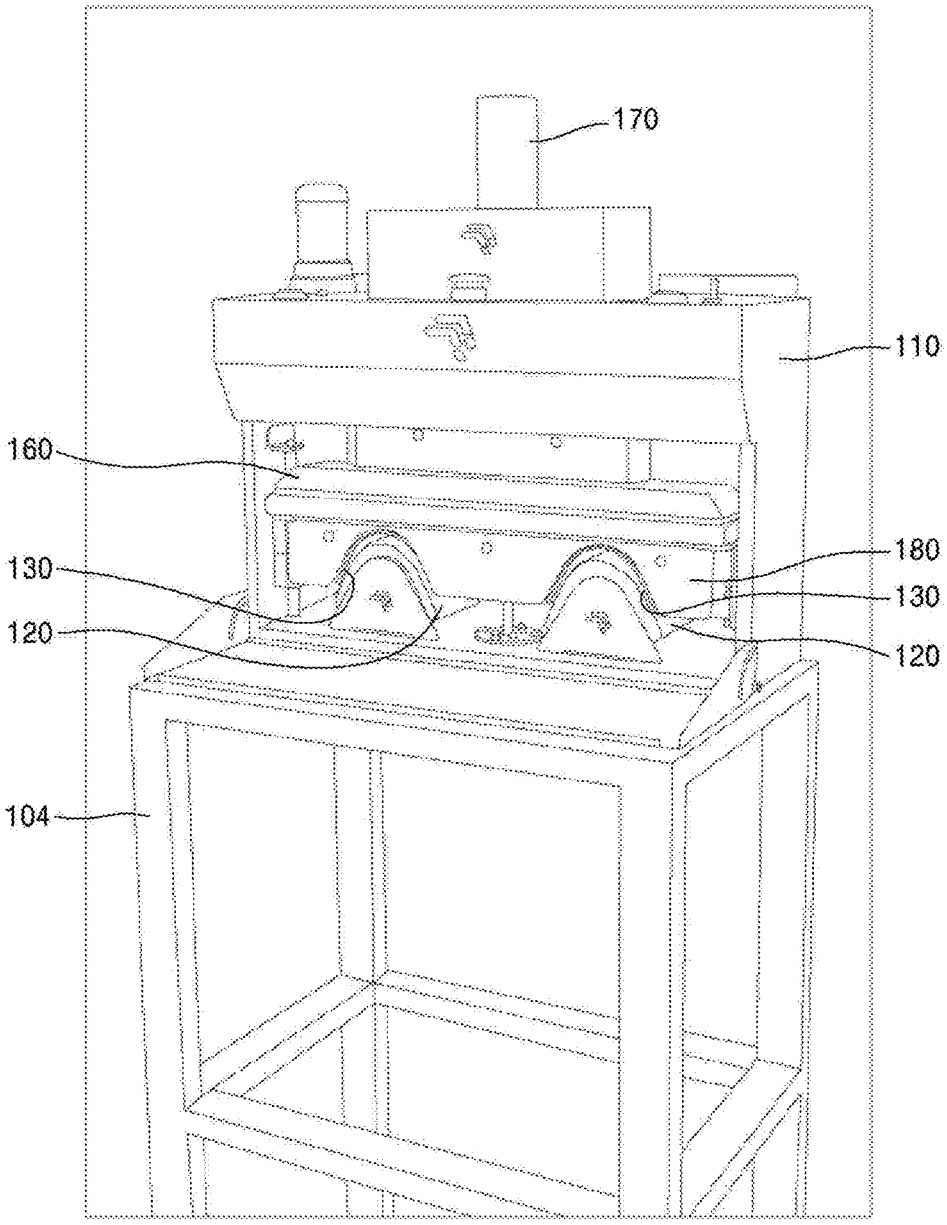
FIG. 18 is a perspective view of a case where a shirt collar and sleeve ironing device is installed on a deck truck, according to an embodiment of the present invention.

FIG. 17 is an image of a case where the shirt collar and sleeve ironing device is installed on a deck truck 104. FIG. 18 is a perspective view of a case where the shirt collar and sleeve ironing device is installed on the deck truck 104, according to an embodiment of the present invention.

Referring to FIGS. 17 and 18, the frame 110 may be detachably installed on the deck truck 104 including wheels 105 formed on a bottom thereof.

Thus, a user may simultaneously, simply and quickly iron the collar 103 and the sleeve 101 of the shirt 100 anytime and anywhere.

Figure 19:
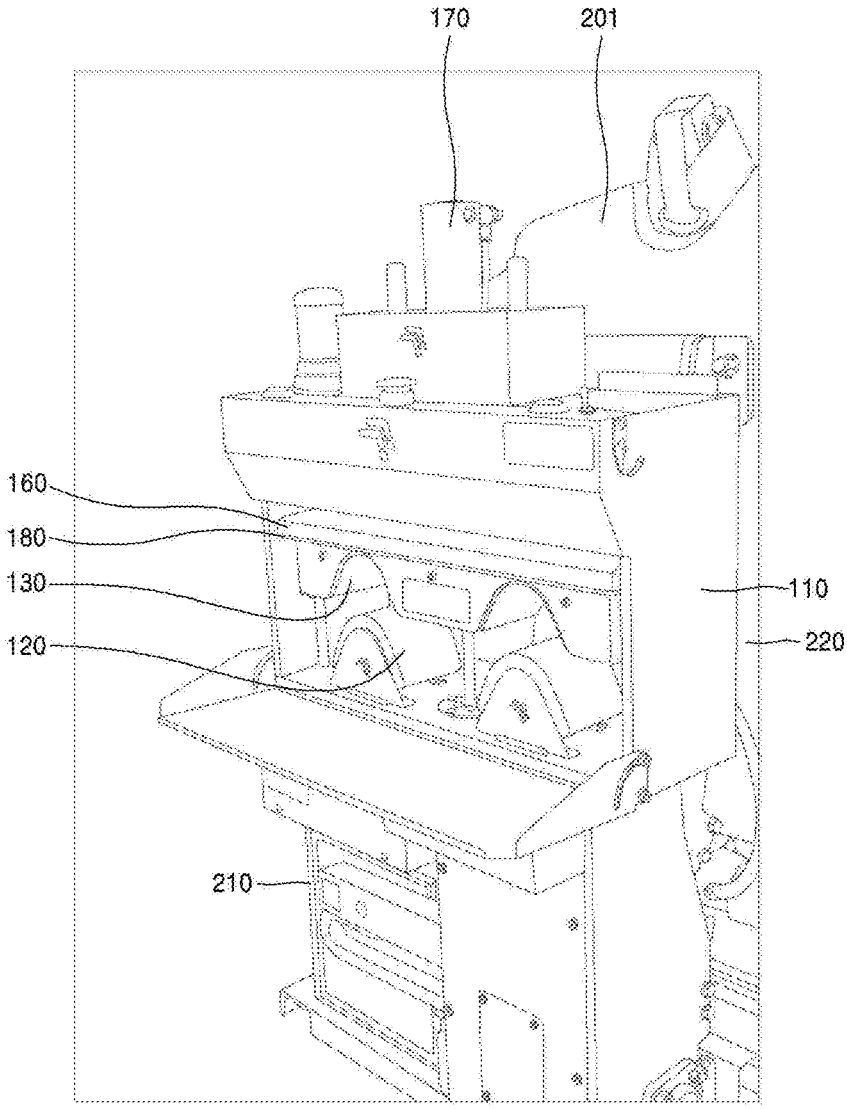
FIG. 19 is a perspective view of a case where a shirt collar and sleeve ironing device is installed on a shirt press, according to an embodiment of the present invention.
Figure 20:
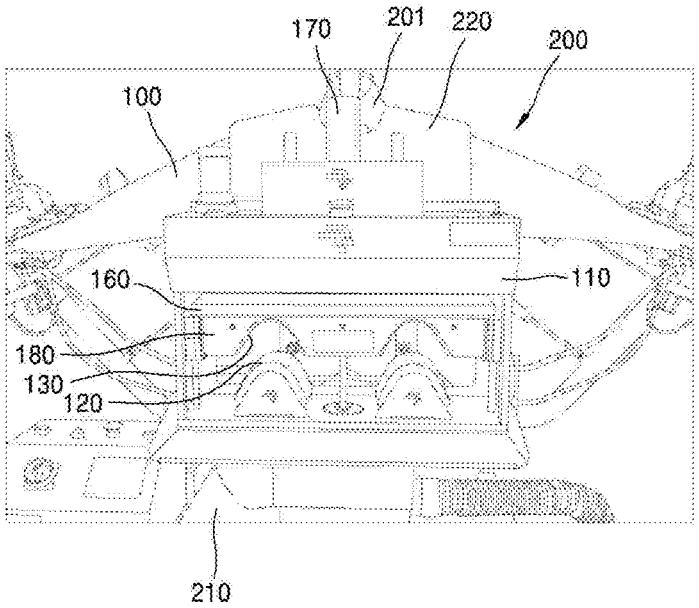
FIG. 20 is a front view of a case where a shirt collar and sleeve ironing device is installed on a shirt press, according to an embodiment of the present invention.
Figure 21:
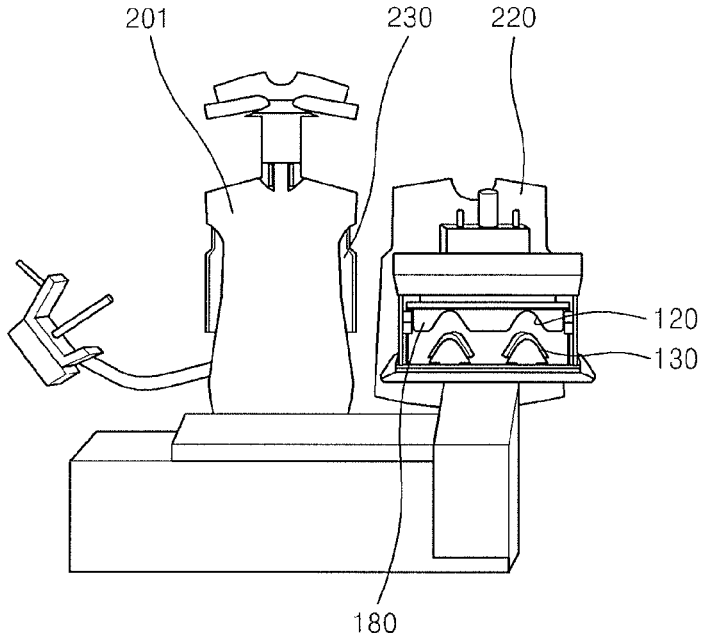
FIG. 21 is an image of an entire image of FIG. 19.

FIG. 19 is a perspective view of a case where the shirt collar and sleeve ironing device is installed on the shirt press 200, according to an embodiment of the present invention. FIG. 20 is a front view of a case where the shirt collar and sleeve ironing device is installed on the shirt press 200, according to an embodiment of the present invention. FIG. 21 is an image of an entire image of FIG. 19.

Referring to FIGS. 19 through 21, the frame 110 may be detachably installed on one side of the shirt press 200 for ironing the shirt 100 supported on a model 201.

The shirt press 200 may include a main body 210 installed on ground; the model 201 installed on the main body 210, for supporting the shirt 100; a front iron 220 installed on the main body 210 and moveable towards the model 201 so as to iron a front part of the shirt 100 supported on the model 201; and a rear iron 230 installed on the main body 210 and moveable towards the model 201 so as to iron a rear part of the shirt 100 supported on the model 201.

In particular, the frame 110 may be detachably installed on a front surface of the front iron 220 as a convenient place so that the user may iron and prepare the sleeve 101 and the collar 103 of another shirt 100 while an ironing operation is performed on the shirt 100 in the shirt press 200.

Figure 22:
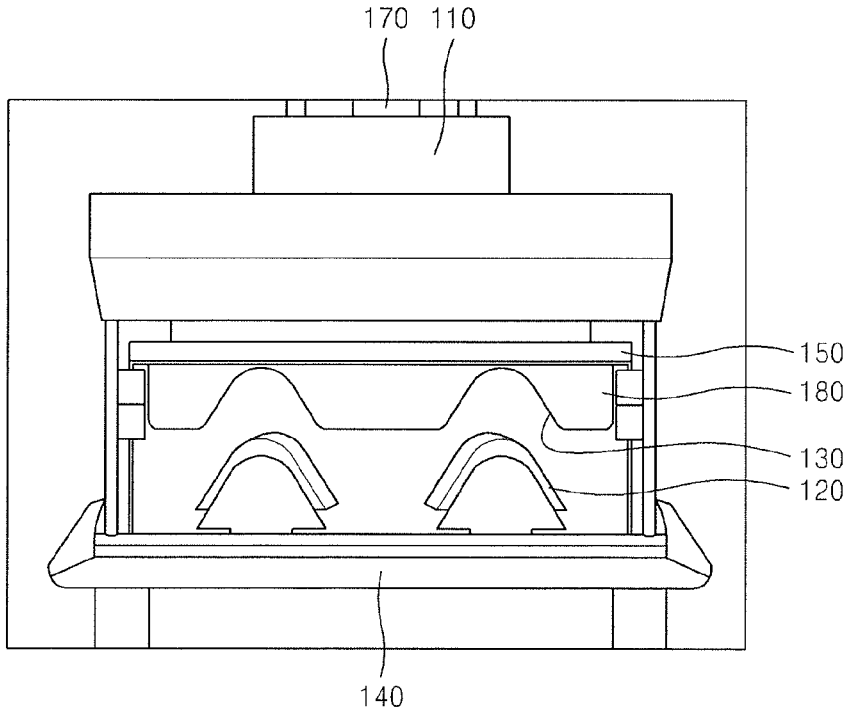
FIG. 22 is an image of a case where a shirt press is on standby.
Figure 23:
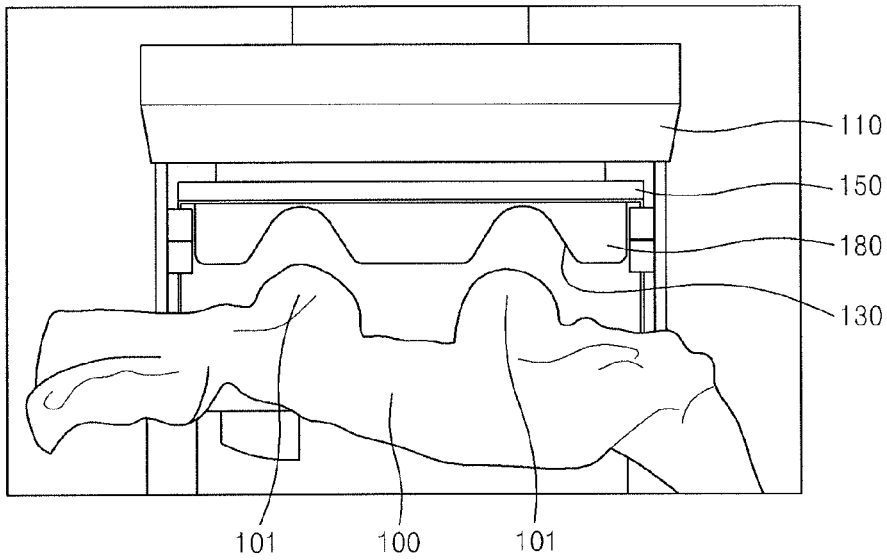
FIG. 23 is an image of a case where a sleeve is supported on a sleeve supporting member.
Figure 24:
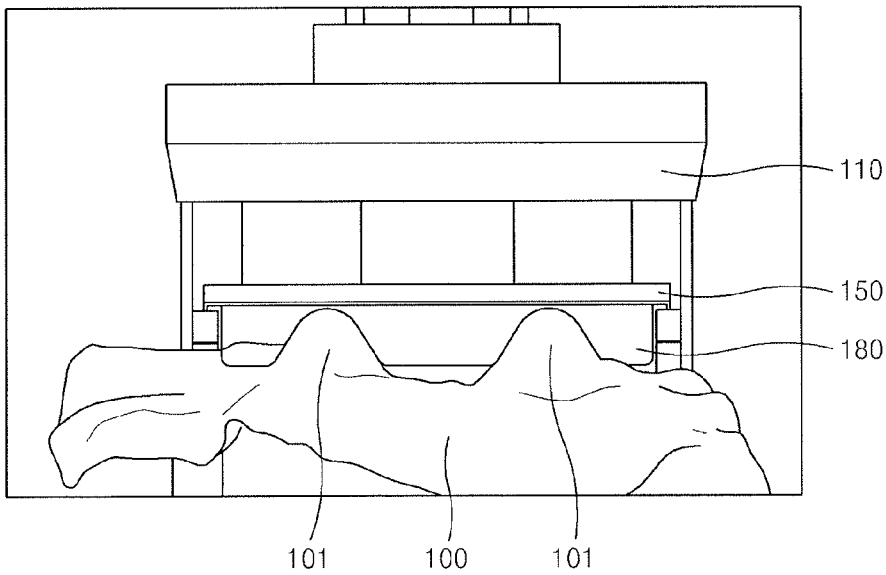
FIG. 24 is an image of a case where a sleeve is ironed.
Figure 25:
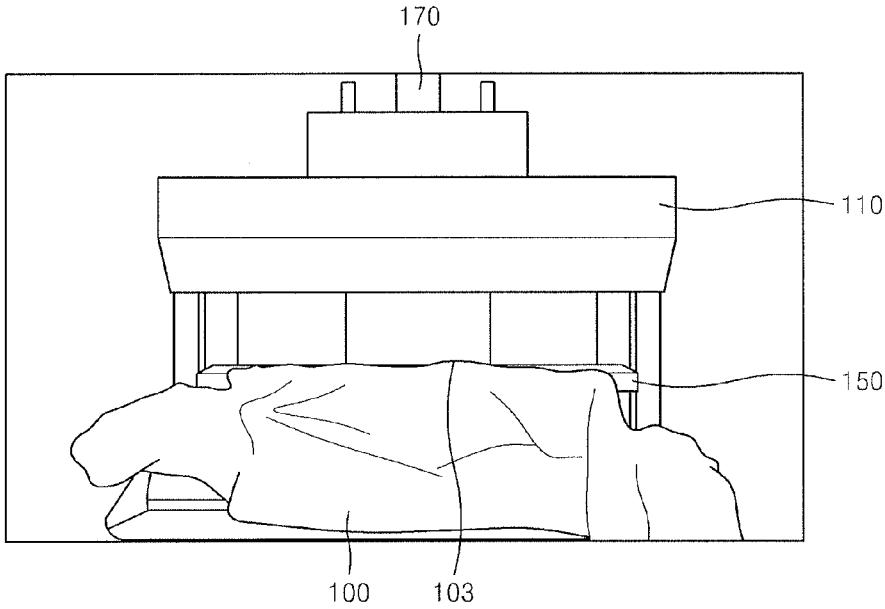
FIG. 25 is an image of a case where a collar is supported on a collar supporting member.
Figure 26:
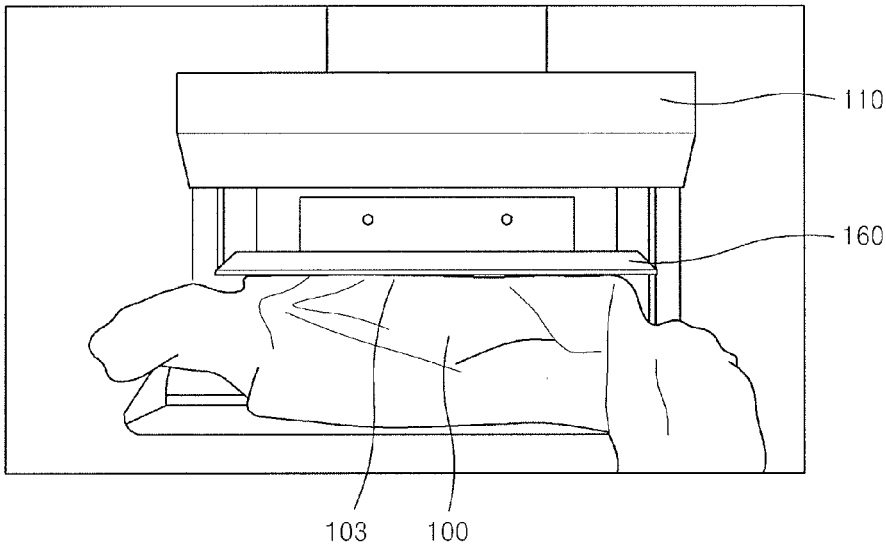
FIG. 26 is an image of a case where a collar is ironed.

FIG. 22 is an image of a case where the shirt press 200 is on standby. FIG. 23 is an image of a case where the sleeve 101 is supported on the sleeve supporting member 120. FIG. 24 is an image of a case where the sleeve 101 is ironed. FIG. 25 is an image of a case where the collar 103 is supported on the collar supporting member 150. FIG. 26 is an image of a case where the collar 103 is ironed.

An operation of the shirt collar and sleeve ironing device according to the present embodiment will be described. The sleeve 101 of the shirt 100 is supported on the sleeve supporting member 120 of FIG. 22, as shown in FIG. 23. Then, as shown in FIG. 24, the sleeve iron 130 is primarily attached to the sleeve supporting member 120 by descending the moving member 180 by using the first actuator 140.

The collar 103 of the shirt 100 is supported on the collar supporting member 150 installed above the moving member 180 of FIG. 25. Then, the collar iron 160 is secondarily attached to the collar supporting member 150 by descending the collar iron 160 by using the second actuator 170, as shown in FIG. 26.

In this case, the sleeve 101 of the shirt 100 is primarily attached between the sleeve supporting member 120 and the sleeve iron 130 by the first actuator 140, and simultaneously is secondarily attached between the sleeve supporting member 120 and the sleeve iron 130 by the second actuator 170. Thus, the quality of an ironing operation may be maximized by a great pressing force by using a hydraulic cylinder with a small capacity, and the size of the shirt press may be minimized.

As described above, according to the shirt press according to one or more embodiments of the present invention, the quality of an ironing operation may be maximized, and an operating speed of a user may be increased. Upper and lower surfaces of a sleeve of shirt may be uniformly ironed, and sleeves may be easily supported. Thus, creases of the sleeves may be prevented, and the collar and sleeves may be simultaneously, simply and quickly ironed. The quality of an ironing operation may be maximized by a great pressing force. A deck truck or shirt press may be installed together with a shirt collar and sleeve ironing device by minimizing the size of the shirt press, thereby obtaining space saving and user's convenience.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A shirt press comprising:

a fixed frame installed on ground;

a model installed on the fixed frame, for supporting a shirt;

a front iron installed on the fixed frame and movable towards the model so as to iron a front part of the shirt supported on the model;

a rear iron installed on the fixed frame and moveable towards the model so as to iron a rear part of the shirt supported on the model;

a sleeve supporter installed on the fixed frame, for stretching a sleeve of the shirt supported on the model;

a lateral stretcher installed on the fixed frame and comprising at least one rods that are folded and unfolded in both directions with respect to the model so as to stretch lateral surfaces of the shirt supported on the model; and a shirt collar and sleeve ironing device installed on the fixed frame or front and rear irons, for ironing a collar and sleeves of a shirt, wherein the shirt collar and sleeve ironing device comprises:

a frame;

a sleeve supporting member installed in the frame, for supporting sleeves of a shirt;

a sleeve iron installed in the frame, for ironing the sleeves of the shirt supported on the sleeve supporting member;

a first actuator for moving the sleeve iron towards the sleeve supporting member;

a collar supporting member installed in the frame, for supporting a collar of the shirt;

a collar iron installed in the frame, for ironing the collar of the shirt supported on the collar supporting member; and a second actuator for moving the collar iron towards the collar supporting member, wherein the shirt collar and sleeve ironing device further comprises a moving member installed on a fixed frame or front and rear irons, and moveable towards the sleeve supporting member, wherein a collar supporting member on which the collar of the shirt is supported is installed on one surface of the moving member, and wherein a sleeve iron for ironing the sleeve of the shirt supported on the sleeve supporting member is installed on the other surface of the moving member.

2. A shirt press comprising:

a fixed frame installed on ground;

a model installed on the fixed frame, for supporting a shirt;

a front iron installed on the fixed frame and movable towards the model so as to iron a front part of the shirt supported on the model;

a rear iron installed on the fixed frame and moveable towards the model so as to iron a rear part of the shirt supported on the model;

a sleeve supporter installed on the fixed frame, for stretching a sleeve of the shirt supported on the model;

a lateral stretcher installed on the fixed frame and comprising at least one rods that are folded and unfolded in both directions with respect to the model so as to stretch lateral surfaces of the shirt supported on the model; and a shirt collar and sleeve ironing device installed on the fixed frame or front and rear irons, for ironing a collar and sleeves of a shirt, wherein the shirt collar and sleeve ironing device comprises:

a frame;

a sleeve supporting member installed in the frame, for supporting sleeves of a shirt;

a sleeve iron installed in the frame, for ironing the sleeves of the shirt supported on the sleeve supporting member;

a first actuator for moving the sleeve iron towards the sleeve supporting member;

a collar supporting member installed in the frame, for supporting a collar of the shirt;

a collar iron installed in the frame, for ironing the collar of the shirt supported on the collar supporting member; and a second actuator for moving the collar iron towards the collar supporting member, wherein the first actuator comprises a hydraulic cylinder installed below the frame so as to move the sleeve iron towards the sleeve supporting member, for primarily descending the moving member towards the sleeve supporting member, and wherein the second actuator comprises a hydraulic cylinder installed above the frame so as to move the collar iron towards the collar supporting member of the moving member, for secondarily descending the collar iron towards the moving member.

3. A shirt press comprising:

a fixed frame installed on ground;

a model installed on the fixed frame, for supporting a shirt;

a front iron installed on the fixed frame and movable towards the model so as to iron a front part of the shirt supported on the model;

a rear iron installed on the fixed frame and moveable towards the model so as to iron a rear part of the shirt supported on the model;

a sleeve supporter installed on the fixed frame, for stretching a sleeve of the shirt supported on the model;

a lateral stretcher installed on the fixed frame and comprising at least one rods that are folded and unfolded in both directions with respect to the model so as to stretch lateral surfaces of the shirt supported on the model; and a shirt collar and sleeve ironing device installed on the fixed frame or front and rear irons, for ironing a collar and sleeves of a shirt, wherein the shirt collar and sleeve ironing device comprises:

a frame;

a sleeve supporting member installed in the frame, for supporting sleeves of a shirt;

a sleeve iron installed in the frame, for ironing the sleeves of the shirt supported on the sleeve supporting member;

a first actuator for moving the sleeve iron towards the sleeve supporting member;

a collar supporting member installed in the frame, for supporting a collar of the shirt;

a collar iron installed in the frame, for ironing the collar of the shirt supported on the collar supporting member; and a second actuator for moving the collar iron towards the collar supporting member, wherein the frame is detachably installed on the front iron.

4. The shirt press of claim 3, wherein the frame is detachably installed on a deck truck comprising wheels formed on a bottom of the deck truck when the frame is detached from the front iron.

* * * * *